US007131718B2

(12) United States Patent
Matsufuji et al.

(10) Patent No.: US 7,131,718 B2
(45) Date of Patent: Nov. 7, 2006

(54) INKJET HEAD AND EJECTION DEVICE

(75) Inventors: Ryouta Matsufuji, Hitachinaka (JP); Satoru Tobita, Hitachinaka (JP); Yoshitaka Akiyama, Hitachinaka (JP); Toshiharu Sumiya, Hitachinaka (JP); Yoshikane Matsumoto, Hitachinaka (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 227 days.

(21) Appl. No.: 10/867,714

(22) Filed: Jun. 16, 2004

(65) Prior Publication Data

US 2004/0263579 A1 Dec. 30, 2004

(30) Foreign Application Priority Data

Jun. 20, 2003 (JP) ..... P 2003-175945

(51) Int. Cl.
*B41J 2/045* (2006.01)

(52) U.S. Cl. ..... 347/68; 347/70

(58) Field of Classification Search ..... 347/68, 347/70–72; 29/25.35

See application file for complete search history.

(56) References Cited

U.S. PATENT DOCUMENTS 5,446,485 A * 8/1995 Usui et al. ..... 347/72
5,818,482 A 10/1998 Ohta et al.
6,070,310 A 6/2000 Ito et al.
6,176,571 B1 * 1/2001 Kishima et al. ..... 347/70
6,273,558 B1 * 8/2001 Kitahara ..... 347/72
6,280,022 B1 * 8/2001 Reinten ..... 347/70
6,315,400 B1 * 11/2001 Sakai et al. ..... 347/70
6,334,671 B1 1/2002 Umehara
6,626,524 B1 * 9/2003 Okazawa et al. ..... 347/68
6,679,589 B1 * 1/2004 Takahagi et al. ..... 347/70
6,682,179 B1 * 1/2004 Takahagi et al. ..... 347/70
2004/0066431 A1 4/2004 Machida et al.

FOREIGN PATENT DOCUMENTS

JP 58-119872 7/1983
JP 1-115638 5/1989
JP 6-8422 1/1994

OTHER PUBLICATIONS

Chinese Office Action dated Mar. 3, 2006, with English translation.

* cited by examiner

*Primary Examiner*—An H. Do
(74) *Attorney, Agent, or Firm*—Whitham, Curtis, Christofferson & Cook

(57) ABSTRACT

A housing of inkjet head has a projection that is formed with a plurality of opening grooves defined between adjacent two of projecting parts, and tip ends of the projecting parts are fixed to a diaphragm plate. Piezoelectric elements are inserted in respective opening grooves and fixed to a diaphragm of the diaphragm plate at positions opposite respective pressure chambers.

22 Claims, 10 Drawing Sheets

INKJET HEAD AND EJECTION DEVICE

BACKGROUND OF THE INVENTION

1. Field of the Invention

The present invention relates to an inkjet head that ejects ink droplets from a nozzle by applying pressure to ink and forms an ink image on a recording medium, and also to an ejection device including the inkjet head.

2. Related Art

As described in Japanese Patent Application-Publication Nos. HEI-1-115638 and SHO-58-119872, there has been known an inkjet head that ejects ink droplets from a nozzle by changing the volume of a pressure chamber using a piezoelectric actuator to apply pressure to the ink.

FIG. 1 shows an example of such inkjet heads. An inkjet head 200 shown in FIG. 1 includes a high-rigidity housing 112, a group of plates 126, and a piezoelectric actuator 114.

A common ink channel 113 and a plurality of openings 112*a* are formed in the high-rigidity housing 112. An ink introduction pipe 118 is connected to the high-rigidity housing 112 for introducing ink from an ink cartridge (not shown) into the common ink channel 113.

The plates 126 are attached to the high-rigidity housing 112 and include a nozzle plate 102, channel plates 103, and a diaphragm plate 110. A plurality of nozzles 101 is formed in the nozzle plate 102. The channel plate 103 includes a chamber plate 105 and a restrictor plate 107. The chamber plate 105 is formed with pressure chambers 104 arranged in a row, and the restrictor plate 107 is formed with restrictors 106. The restrictors 106 fluidly connect the common ink channel 113 to the pressure chambers 104 and control ink flow to the pressure chambers 104. A diaphragm 108 and a filter section 109 are formed on the diaphragm plate 110. The filter section 109 is formed of a filter plate that has elasticity and removes foreign matter and the like from ink flowing into the restrictors 106 from the common ink channel 113.

The piezoelectric actuator 114 includes a plurality of piezoelectric elements 115 and a securing member 116 that secures the piezoelectric elements 115. Each piezoelectric element 115 corresponds to one of the pressure chambers 104 formed in the chamber plate 105. The piezoelectric elements 115 are housed in the respective openings 112*a* of the high-rigidity housing 112 and attached to the diaphragm 108. On the securing member 116 are formed individual electrodes 117 for sending independent electrical signals to the respective piezoelectric elements 115 from an external drive circuit (not shown). Applying electrical signals selectively to the piezoelectric elements 115 causes the piezoelectric elements 115 to expand and contract. The diaphragm 108 transfers the displacement (expansion/contraction) of the piezoelectric element 115 to the pressure chambers 104 and changes the volume of the pressure chambers 104. This change of the volume becomes a change of pressure of the ink filling the pressure chambers 104. As a result, ink is ejected through the nozzles 101 as ink droplets.

Usually, the nozzle plate 102 is formed by stainless steel precision pressing, laser processing, nickel electroforming, or the like, and the chamber plate 105, the restrictor plate 107, and the diaphragm plate 110 are formed by stainless-steel material etching or nickel material electroforming. The high-rigidity housing 112 is formed by stainless-steel material cutting or the like.

The processing precision (shape) of the nozzle 101 greatly affects the ink ejection characteristics of the inkjet head 200. In order to suppress variations in position precision of the plurality of nozzles 101, high processing precision is required when the nozzle plate 102 is manufactured.

There is now a continual demand for significantly higher precision of the nozzles 101 in the inkjet head 200. However, if the density of nozzles 101 is further increased, it is difficult from a processing precision standpoint to form the opening 112*a* for each piezoelectric element 115 in the high-rigidity housing 112. That is to say, high processing precision is required because the expansion/contraction amount of the piezoelectric elements 115 is extremely small (about 0.5 μm), and a slight difference in structure or dimensional values of the opening 112*a* and the like will fluctuate the amount of deformation of the plates 126, affecting ink-ejection characteristics.

FIG. 2 shows an inkjet head, disclosed in Japanese Patent-Application Publication No. HEI-6-8422, proposed for overcoming the above-described problem. The inkjet head of FIG. 2 includes a chamber plate 206 and a housing 212. The chamber plate 206 is formed with a row of pressure chambers 204. The housing 212 has greater rigidity than the chamber plate 206 and is formed with an opening 212A that extends in the same direction as the row of pressure chambers 204. A plurality of piezoelectric elements 215 is fixed to the chamber plate 206 at positions in the opening 212A that confront the pressure chambers 204. A fixing base 216 formed with a thin-film electrode 219 is attached to each piezoelectric element 215 so that a portion of the thin-film electrode 219 is in intimate contact with the corresponding piezoelectric element 215. A lead 217 is connected to an exposed surface of each thin-film electrode 219. When a voltage is supplied through the lead 217 to the corresponding piezoelectric element 215, the piezoelectric element 215 contracts in its lengthwise direction, that is, the direction indicated by an arrow Z in FIG. 2. When application of voltage is stopped, then the piezoelectric element 215 reverts to its initial state. Because no member is provided in between adjacent piezoelectric elements 215 for guiding the piezoelectric elements 215 in the configuration of FIG. 2, the piezoelectric elements 215 can be aligned in a much higher density than with the configuration of FIG. 1.

If the pressure chambers 204 are formed with a large width to ensure that ink droplets are sufficiently large, then the width of the opening 212A in the housing 212 must also be enlarged. This increases the cross-sectional surface area of the opening 212A. Also, the ejection head must be made longer in the nozzle row direction in order to increase the number of nozzles to increase print speed. This also increases the cross-sectional surface area of the opening 212A.

However, the chamber plate 206 is extremely thin, that is, with a thickness of only about 0.8 mm to 1.0 mm. The section of the chamber plate 206 that is formed with the pressure chambers 204 has a total thickness of only about 0.4 mm to 0.6 mm. Accordingly, if the opening 212A of the housing 212 is too large, then deformation of any one of the piezoelectric elements 215 will deform the entire chamber plate 206 and not just the corresponding pressure chamber 204. The displacement generated by the piezoelectric elements 215 is not effectively used to eject ink droplets. Also, crosstalk can be generated between neighboring nozzles that reduces consistency in speed of ejected ink droplets or otherwise degrades ejection characteristic. Crosstalk can become particularly serious when a great number of piezoelectric elements 215 are driven simultaneously. When neighboring pressure chambers 204 are affected by and deform simultaneously with a pressure chamber 204 that is driven to eject ink, the ink meniscus in nozzles corresponding to the neighboring pressure chambers 204 can vibrate.

SUMMARY OF THE INVENTION

In the view of foregoing, it is an object of the present invention to overcome the above problems, and also to provide an inkjet head that reduces the amount of deformation of plates and prevents crosstalk, and an ejection device including the inkjet head.

It is a further object of the present invention to provide an inkjet head that enables to mount piezoelectric elements with high density and an ejection device including the inkjet head.

In order to attain the above and other objects, according to one aspect of the present invention, there is provided an inkjet head including a nozzle plate formed with a plurality of nozzles through which ink droplets are ejected, a channel plate formed with a plurality of pressure chambers corresponding to the respective nozzles, a diaphragm plate that has a diaphragm, the diaphragm sealing the pressure chambers, a plurality of piezoelectric elements attached to the diaphragm at positions opposite the respective pressure chambers, and a housing that houses the plurality of piezoelectric elements. The housing has a projection in contact with the diaphragm plate. The projection is formed with opening grooves and has projecting parts. Each of the opening grooves is defined between adjacent two of the projecting parts, and each of the piezoelectric elements is inserted in the corresponding one of the opening grooves.

According to different aspect of the present invention, there is provided an ejection device including an inkjet head and an ink cartridge that supplies ink to the inkjet head. The inkjet head includes a nozzle plate formed with a plurality of nozzles through which ink droplets are ejected, a channel plate formed with a plurality of pressure chambers corresponding to the respective nozzles, a diaphragm plate that has a diaphragm, the diaphragm sealing the pressure chambers, a plurality of piezoelectric elements attached to the diaphragm at positions opposite the respective pressure chambers, and a housing that houses the plurality of piezoelectric elements. The housing has a projection in contact with the diaphragm plate. The projection is formed with opening grooves and has projecting parts. Each of the opening grooves is defined between adjacent two of the projecting parts, and each of the piezoelectric elements is inserted in the corresponding one of the opening grooves.

PREFERRED EMBODIMENT OF THE PRESENT INVENTION

An embodiment of the present invention will be described while referring to the accompanying drawings.

Figure 1:
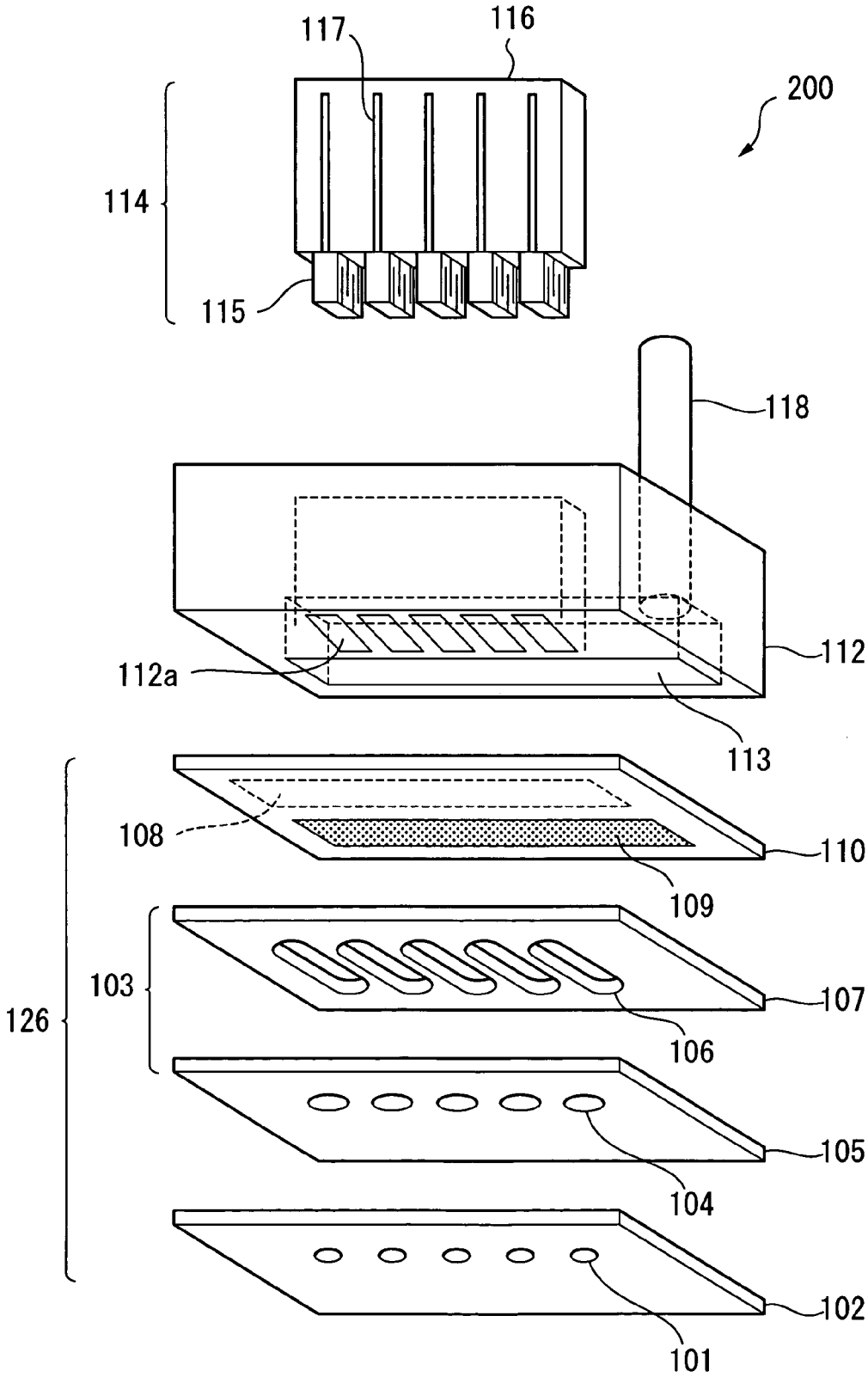
FIG. 1 RELATED ART
FIG. 1 is an exploded perspective view showing a conventional inkjet head.
Figure 2:
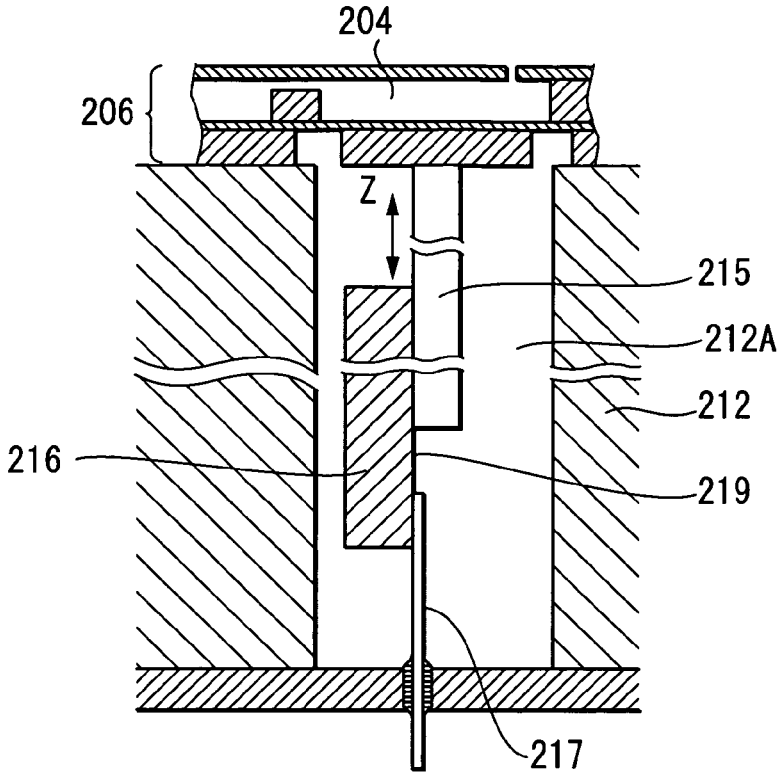
FIG. 2 RELATED ART
FIG. 2 is a cross-sectional view of a conventional inkjet head.
Figure 3:
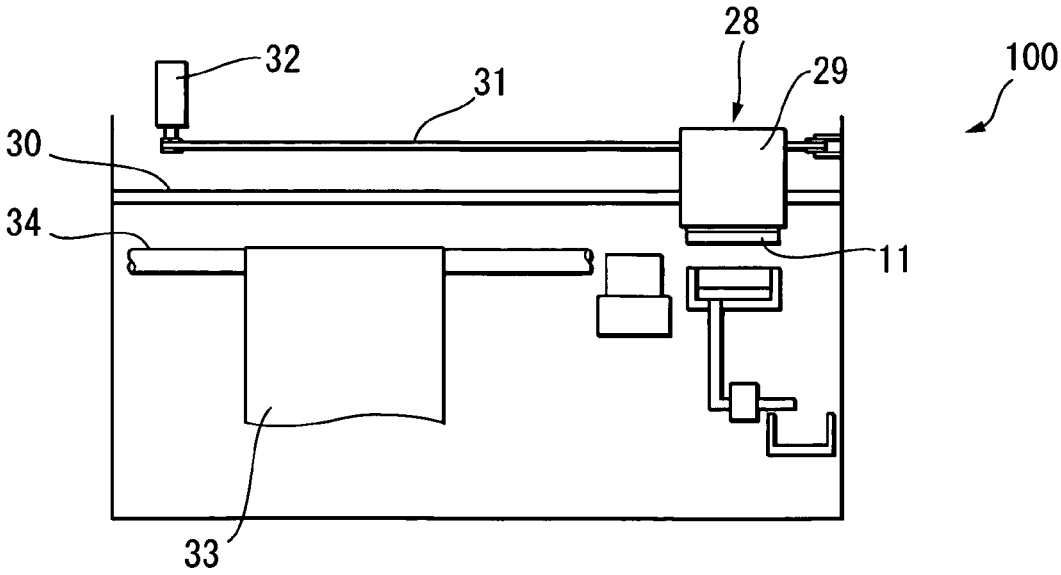
FIG. 3 is a schematic view of an ejection device according to an embodiment of the present invention.

FIG. 3 shows a configuration of an ejection device 100 according to the present embodiment. As shown in FIG. 3, the ejection device 100 includes a recording unit 28, a guide shaft 30, a drive transfer member 31, a drive source 32, and a transport roller 34.

The recording unit 28 is supported in a freely sliding fashion on the guide shaft 30. The recording unit 28 is coupled to the drive transfer member 31 and moved along the guide shaft 30 by the drive source 32. The recording unit 28 includes an inkjet head 11 and an ink cartridge 29. The inkjet head 11 has a width equivalent to a recording width. The ink cartridge 29 supplies ink to the inkjet head 11.

During printing, the recording unit 28 is stationary above a printing area. On the other hand, a print medium 33 is transported by the transport roller 34 in a direction orthogonal to the direction of movement of the recording unit 28, to a position opposite the inkjet head 11. The inkjet head 11 ejects ink droplets in accordance with a recording signal to form an image on the print medium 33.

Figure 4:
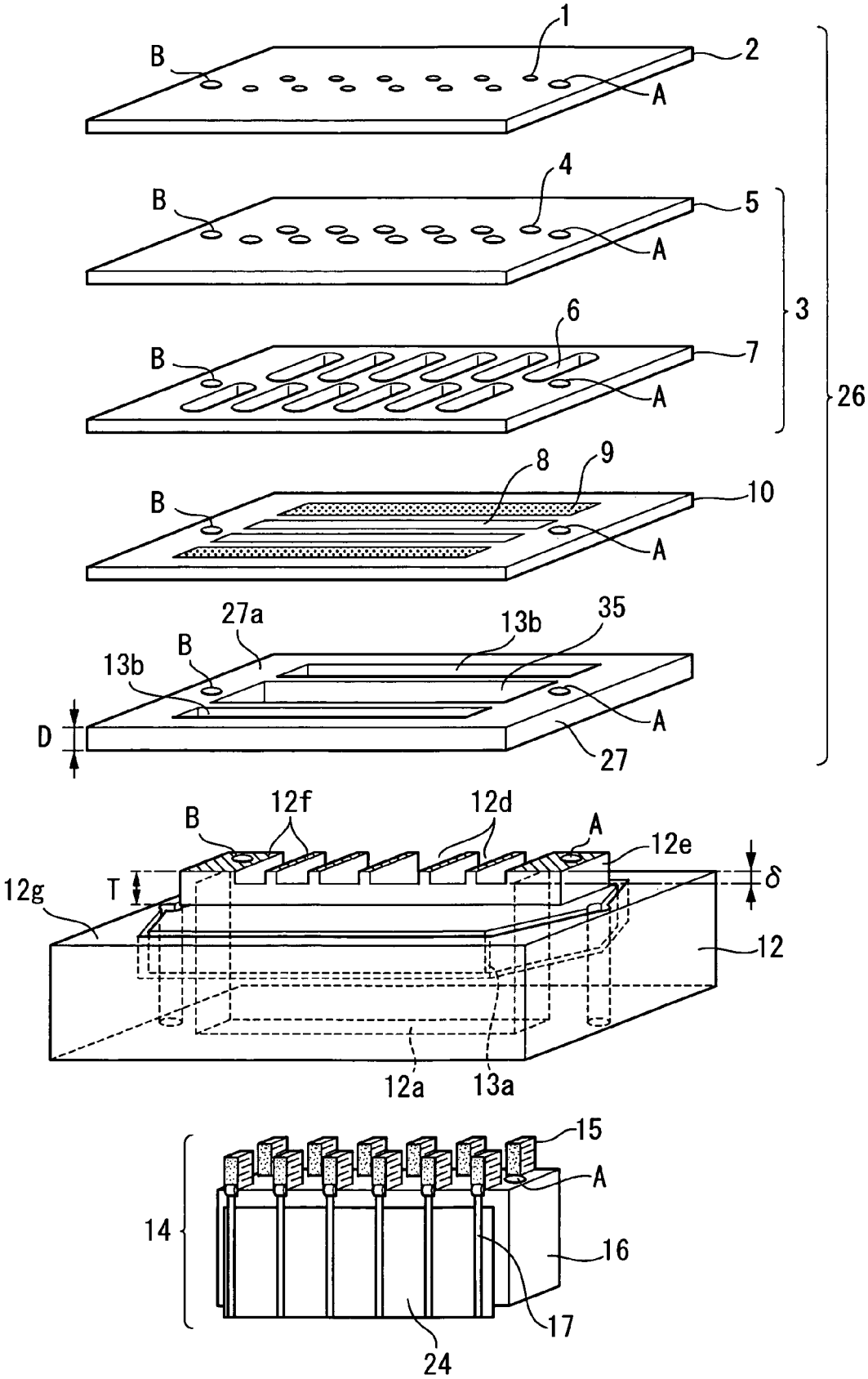
FIG. 4 is an exploded perspective view of an inkjet head of the ejection device according to the embodiment of the present invention.
Figure 5:
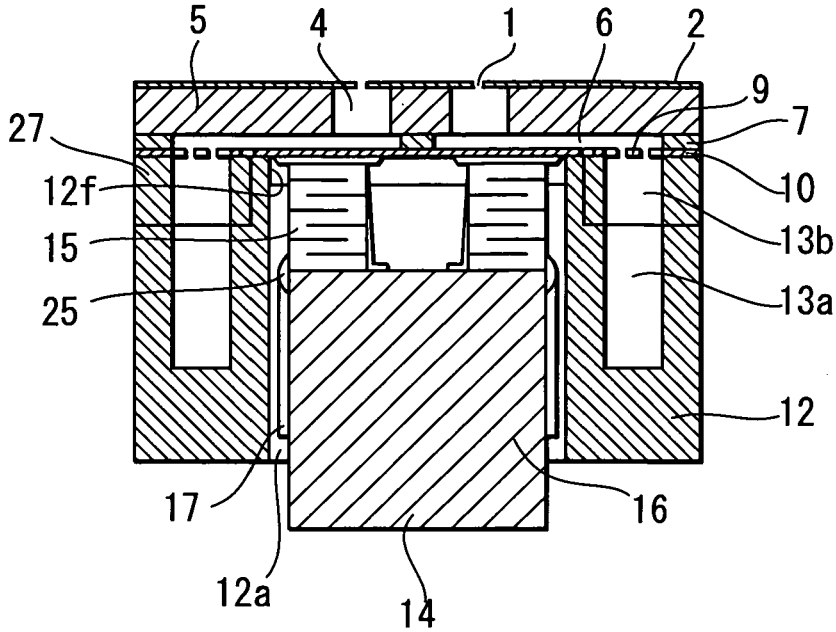
FIG. 5 is a cross-sectional view of the inkjet head of FIG. 4.

The configuration of the inkjet head 11 will be described in detail with reference to FIGS. 4 to 6. As shown in FIGS. 4 and 5, the inkjet head 11 includes a group of plates 26, a high-rigidity housing 12, and a piezoelectric actuator 14.

The plates 26 are fixed to the high-rigidity housing 12 and includes a nozzle plate 2, channel plates 3, a diaphragm plate 10, and an ink chamber plate 27, laminated in this order.

In order to achieve high-density implementation, a plurality of nozzles 1 are formed in two rows in the nozzle plate 2.

The channel plates 3 include a chamber plate 5 and a restrictor plate 7. The chamber plate 5 is formed with a plurality of pressure chambers 4 arranged in two rows such that the rows of the nozzles 1 are sandwiched between the rows of the pressure chambers 4. The pressure chambers 4 in one row are disposed opposite the respective pressure chambers 4 in the other row. In other words, the pressure chambers 4 are arranged in symmetrical about the rows of the nozzles 1. Each pressure chamber 4 is in fluid communication with the corresponding nozzle 1.

The restrictor plate 7 is formed with a plurality of restrictors 6. The restrictors 6 are for fluidly connecting common ink chambers 13*b* formed in the ink chamber plate 27 to the pressure chambers 4 and control flow of ink to the pressure chambers 4.

The diaphragm plate 10 is formed with a pair of diaphragms 8 and a pair of filter sections 9. The filter sections 9 remove foreign matter and the like from ink flowing into the restrictors 6 from the common ink chambers 13*b*.

The ink chamber plate 27 is for supporting the plates 2, 3, and 10, and formed with an opening 35 and the pair of common ink chambers 13*b*.

The high-rigidity housing 12 is formed with a common ink channel 13*a* and a central opening 12*a*. The common ink chambers 13*b* formed in the ink chamber plate 27 are in fluid communication with the ink supply channel 13*a* at both lengthwise ends of the common ink chambers 13*b*.

Figure 6:
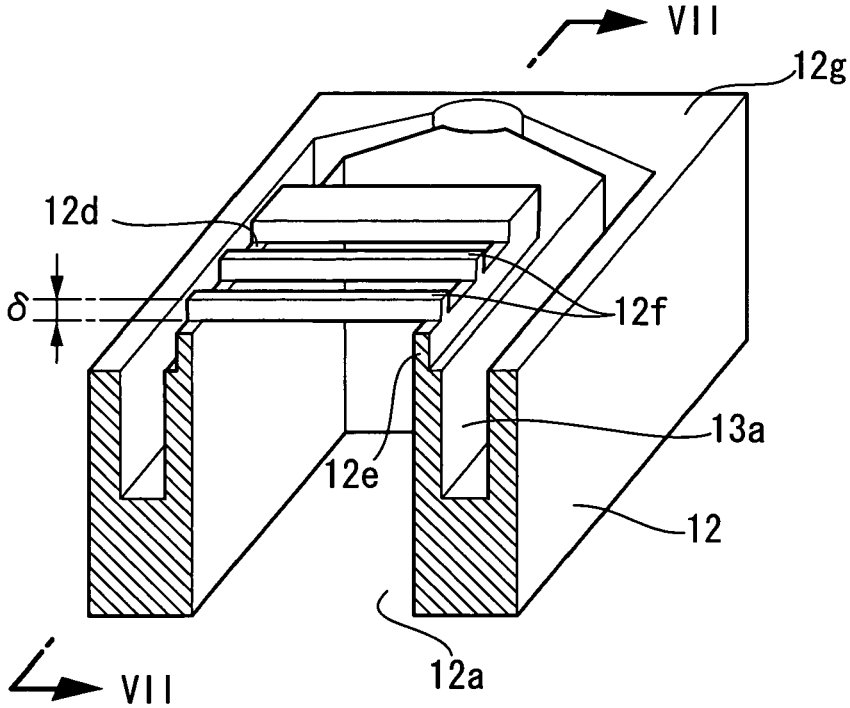
FIG. 6 is a partially cut-away perspective view of a high-rigidity housing of the inkjet head according to the embodiment of the present invention.

As shown in FIGS. 4 and 6, the high-rigidity housing 12 has a plate attachment surface 12*g* facing the plates 26 and a protrusion 12*e* on the plate attachment surface 12*g*. The protrusion 12*e* is engaged with and fixed to the opening 35 of the ink chamber plate 27. The protrusion 12*e* is formed with a plurality of opening grooves 12*d*, thereby providing comb-shaped projecting parts 12*f* between adjacent opening grooves 12*d*. The tip ends of the comb-shaped projecting parts 12*f* are fixed to the diaphragm plate 10, and the plate attachment surface 12*g* is fixed to the ink chamber plate 27.

As shown in FIG. 4, the piezoelectric actuator 14 includes a plurality of piezoelectric elements 15 and a securing member 16. Ends of the piezoelectric elements 15 at one side are fixed to the securing member 16, and surfaces of the free ends of the piezoelectric elements 15 at other side occupy a common plane. The piezoelectric elements 15 are arranged in two rows such that the piezoelectric elements 15 in one row are opposite the piezoelectric elements 15 in the other row. The securing member 16 is electrically conductive. Individual electrodes 17 are formed on the securing member 16 for sending independent electrical signals to the respective piezoelectric elements 15 from an external drive circuit (not shown).

The piezoelectric actuator 14 is housed in the opening 12*a* formed in the high-rigidity housing 12, and the piezoelectric elements 15 are inserted in the corresponding opening grooves 12*d* formed in the protrusion 12*e*. As shown in FIG. 5, the free ends of the piezoelectric elements 15 are fixed to the corresponding diaphragms 8 of the diaphragm plate 10 at positions opposite the corresponding pressure chambers 4.

The ink chamber plate 27 prevents ink flowing into the piezoelectric actuator 14 from the common ink channel 13*a* of the high-rigidity housing 12 and prevents electrical conduction between electrodes of the piezoelectric elements 15, thereby preventing destruction of the piezoelectric elements 15.

With this configuration, when selective electrical signals are applied to the piezoelectric elements 15 from the external drive circuit, the piezoelectric elements 15 expand and contract to change the volume of the pressure chambers 4 via the diaphragms 8. As a result, pressure is applied to ink in the pressure chambers 4, ejecting ink droplets through the nozzles 1.

Next, process for manufacturing the piezoelectric actuator 14 will be described with reference to FIGS. 8 to 12.

Figure 8:
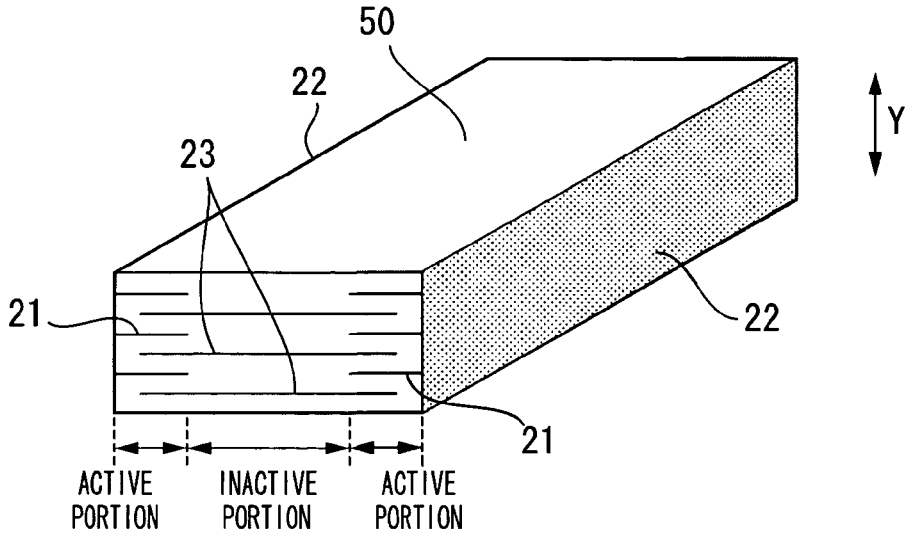
FIG. 8 is an explanatory view showing a manufacturing process of a piezoelectric actuator of the inkjet head according to the embodiment of the present invention.

First, a piezoelectric entity 50 such as shown in FIG. 8 is prepared. The piezoelectric entity 50 is provided with external electrodes 22 and internal electrodes 21 and 23. The external electrodes 22 are formed on both sides of the piezoelectric entity 50, and the internal electrodes 21 and 23 are stacked alternately in a Y direction. The internal electrodes 21 are electrically connected to the external electrodes 22, and the internal electrodes 23 are positioned in the center of the piezoelectric entity 50. With this configuration, an inactive section in which no electric field is generated is formed in the central of the piezoelectric entity 50, and active sections in which displacement occurs due to an electric field are formed on both sides of the piezoelectric entity 50.

Figure 9:
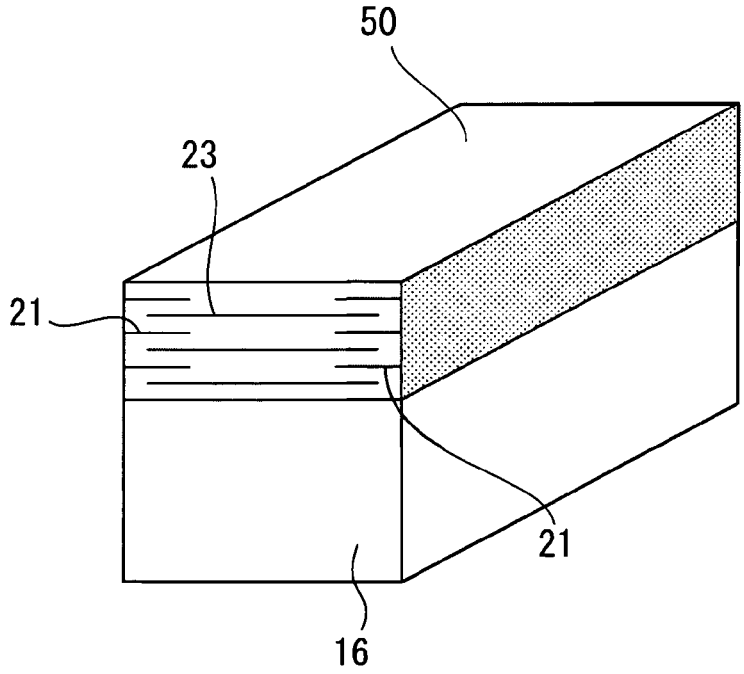
FIG. 9 is an explanatory view showing a manufacturing process of the piezoelectric actuator.
Figure 10:
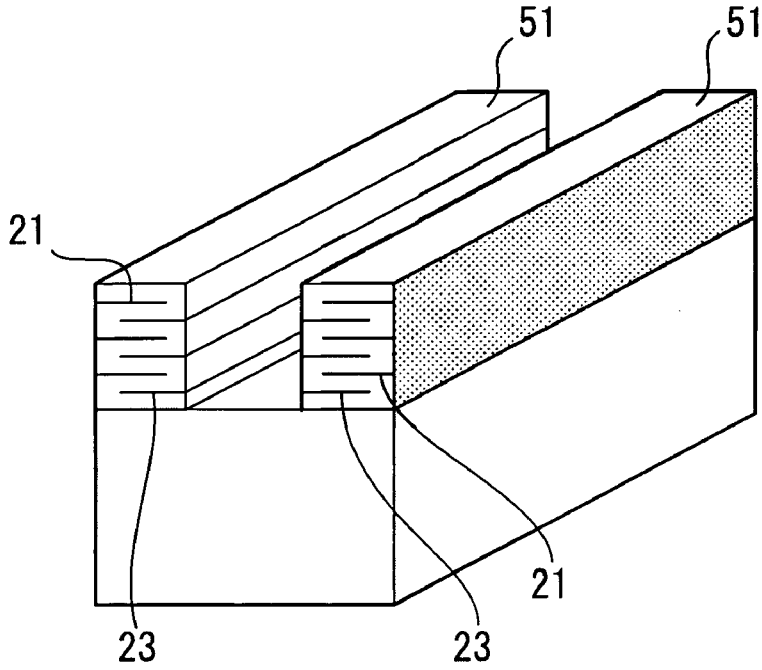
FIG. 10 is an explanatory view showing a manufacturing process of the piezoelectric actuator.
Figure 11:
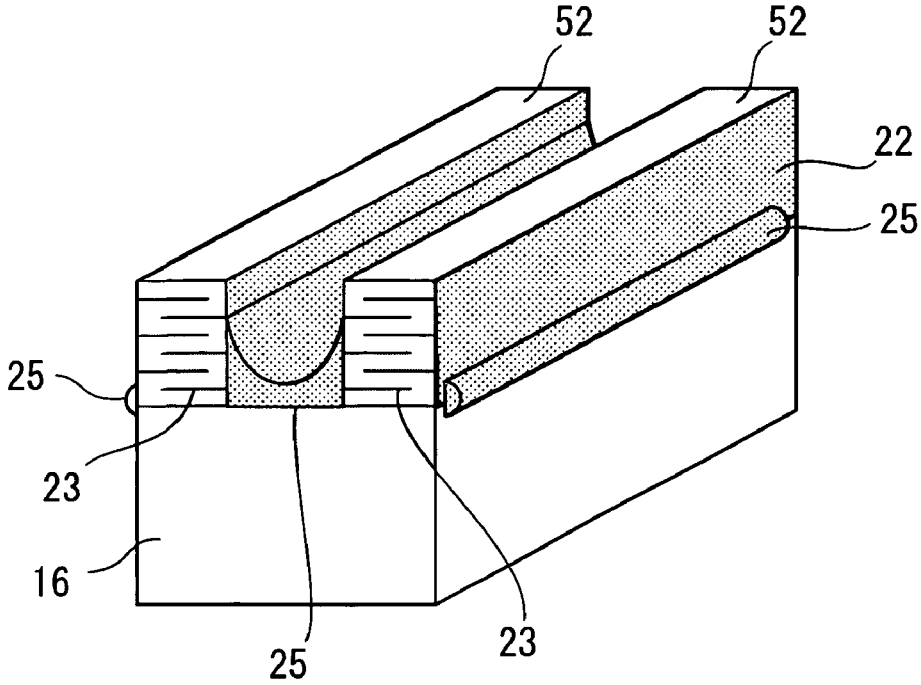
FIG. 11 is an explanatory view showing a manufacturing process of the piezoelectric actuator.

Next, the piezoelectric entity 50 is fixed to the securing member 16 as shown in FIG. 9. Then, the piezoelectric entity 50 is cut using a dicing saw, wire saw, or the like, and divided into two piezoelectric entities 51 as shown in FIG. 10, such that each piezoelectric entity 51 includes an active section and an inactive section. Next, conductive adhesive material 25 is filled in the cut-out section as shown in FIG. 11, electrically connecting the internal electrodes 23 and the securing member 16. Conductive adhesive material 25 is also applied to the outer surfaces of the piezoelectric entities 51, electrically connecting the external electrodes 22 to the securing member 16. As a result, a pair of piezoelectric element entities 52 is formed. It should be noted that it is unnecessary to fill the cut-out section completely with the conductive adhesive material 25. However, the internal electrodes 23 need to be electrically connected to the securing member 16.

Figure 12:
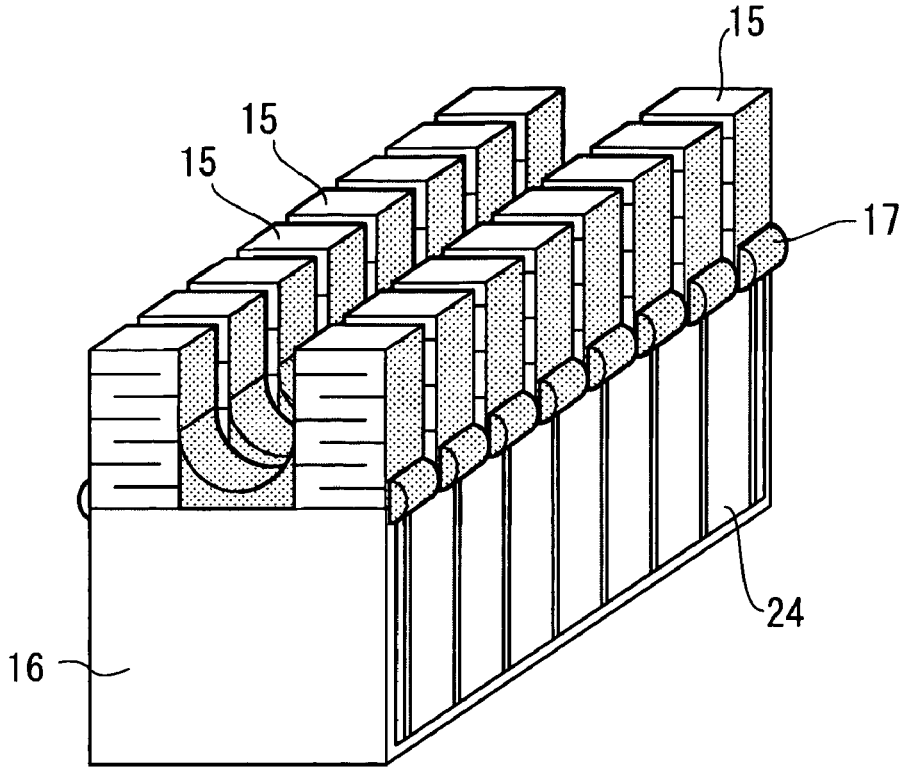
FIG. 12 is a perspective view of the piezoelectric actuator.

Next, as shown in FIG. 12, flexible printed cables (FPCs) 24 are affixed to both sides of the securing member 16, and the external electrodes 22 and the flexible printed cables 24 are connected by electrodes 17. Lastly, the piezoelectric element entities 52 are cut at a fixed pitch and divided into the plurality of piezoelectric elements 15 so as to correspond to the pressure chambers 4. Because the piezoelectric entity 50 is first attached to the securing member 16 and then cut, a high positional relationship can be achieved between two rows of the piezoelectric elements 15 on the securing member 16.

It should be noted that it is possible to prepare two piezoelectric element entities 52 in a bar shape and fix the same onto the securing member 16, and then divide the piezoelectric element entities 52 into the plurality of piezoelectric elements 15. In this case, the positional precision between the piezoelectric element entities 52 could degrade. However, this procedure reduces the amount of conductive adhesive material 25 applied between the piezoelectric element entities 52 and improves workability.

When forming the above-described comb-shaped opening grooves 12*d* in the protrusion 12*e*, the same kind of processing method can be used as when dividing the piezoelectric entities 52 into the piezoelectric elements 15 with a dicing saw, wire saw, or the like. By performing such processing, it is possible to achieve the same dimensional precision of the opening grooves 12*d* (the projecting parts 12*f*) as the processing precision of the piezoelectric actuator 14 in easy manner, and the positional precision between and assembly precision of the piezoelectric actuator 14 and the high-rigidity housing 12 can be improved. This makes it possible to increase the density of the piezoelectric elements 15, enabling increase in density of the nozzles.

Also, because the comb-like projecting parts 12*f* of the high-rigidity housing 12 are fixed to the diaphragm plate 10, the comb-like projecting parts 12*f* can suppress deformation of the plates 26 due to expansion/contraction of the piezoelectric elements 15, preventing variation in ink characteristics, crosstalk, and the like.

In order to support the group of plates 26 in this manner, it is desirable that the rigidity of the housing 12, at least the rigidity of the protrusion 12*e* of the housing 12, be greater than that of the group of plates 26.

Figure 7:
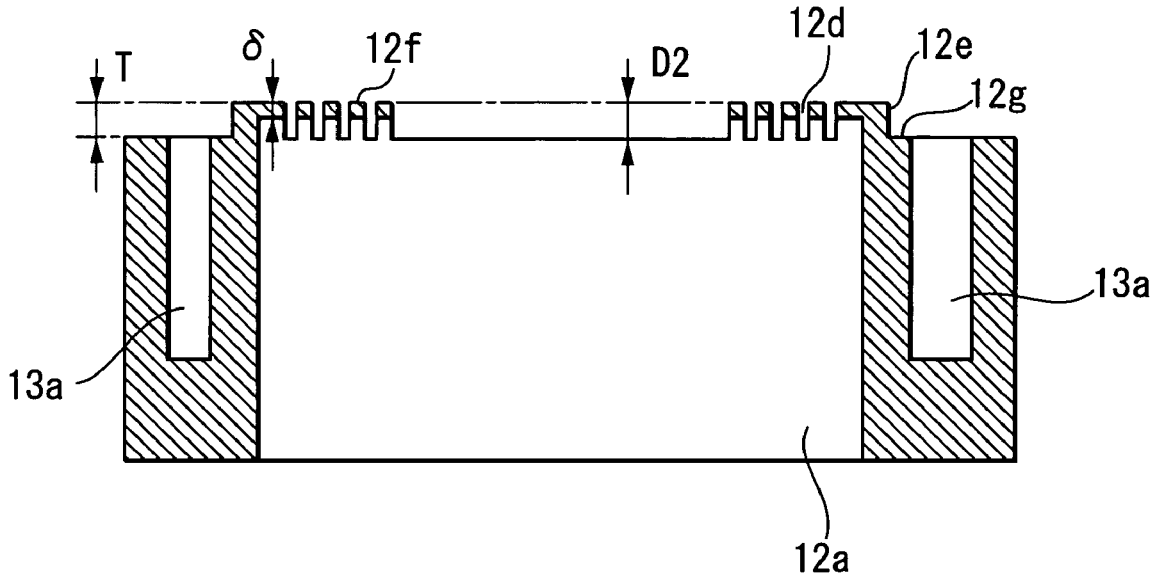
FIG. 7 is a cross-sectional view of the high-rigidity housing along a line VII—VII of FIG. 6.

Also, it is preferable that a depth D2 (FIG. 7) of the opening grooves 12*d* be no deeper than necessary to prevent grooves being formed in the plate attachment surface 12*g* around the protrusion 12*e*. That is to say, it is preferable that the depth D2 of the opening grooves 12*d* be less than a height T of the protrusion 12*e*. This is because if the opening grooves 12*d* are formed as far as the plate attachment surface 12*g* of the high-rigidity housing 12, then there is a risk of grooves being formed in the plate attachment surface 12*g*. In this case, these grooves may not be completely filled with adhesive, and slight gaps may be left when the plate attachment surface 12*g* is attached to the ink chamber plate 27 by adhesive. Then, ink may flow into the opening 12*a* from the common ink passages 13*b* through these gaps and damage the piezoelectric actuator 14.

The present inventors conducted an experiment to study the relationship between a number of nozzles that are driven simultaneously with a basic nozzle (hereinafter referred to as "simultaneously-driven nozzle number") and change in droplet velocity ratio caused due to crosstalk, and the relationship between the simultaneously-driven nozzle number and the deformation amount ratio of the group of plates 26, in an inkjet head having the above-described configuration. Note that a nozzle at or around the center of the nozzle row (if the nozzle row includes 96 nozzles, then the 48th or 49th nozzle counting from one end) is taken as the basic nozzle. The droplet velocity ratio indicates the ratio between "ejection velocity of the basic nozzle when the basic nozzle only is driven" and "ejection velocity of the basic nozzle when nozzles on either sides of the basic nozzle are driven simultaneously with the basic nozzle". In the experiment, the number of nozzles that are driven simultaneously with the basic nozzle is successively increased. The deformation amount ratio of the group of plates 26 indicates the ratio between the amount of deformation of the piezoelectric elements 15 and the amount of deformation of the group of plates 26.

In this experiment, an inkjet head having a row of 50 μm-diameter nozzles arranged at nozzle pitch of approximately 37.4 dpi and configured to eject approximately 60 pl (Pico liters) of ink droplet at ejection velocity of approximately 10 m/s. However, the results do not differ for an inkjet head that has nozzles arranged in a plurality of rows.

Figure 13:
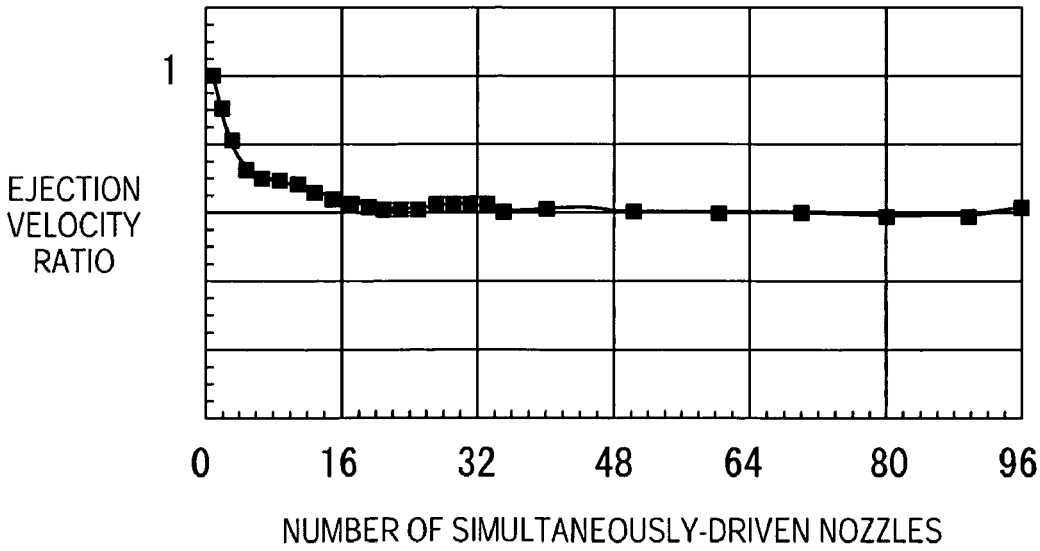
FIG. 13 is a graph showing the relationship between a simultaneously-driven nozzle number and a droplet velocity ratio.
Figure 14:
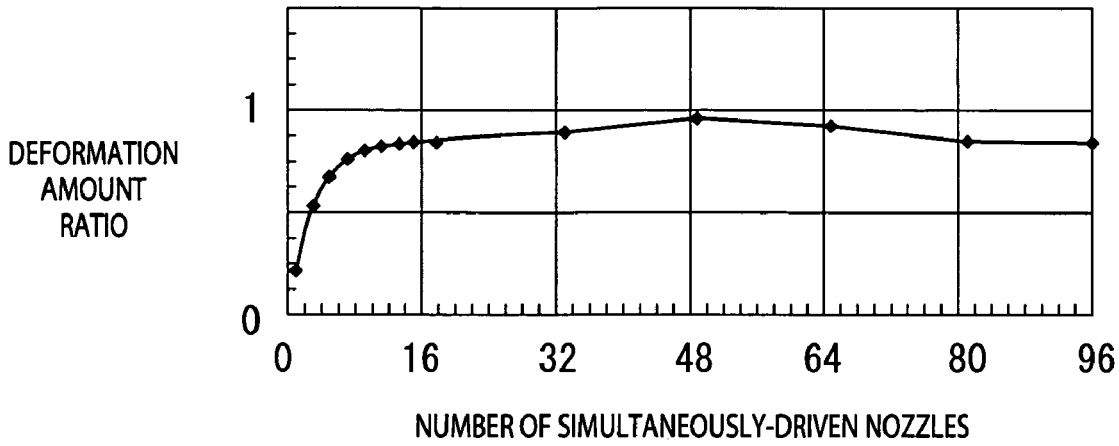
FIG. 14 is a graph showing the relationship between the simultaneously-driven nozzle number and a nozzle plate deformation amount ratio.

FIG. 13 shows the relationship between the simultaneously-driven nozzle number and the droplet velocity ratio obtained in this experiment, and FIG. 14 shows the relationship between the simultaneously-driven nozzle number and the deformation amount ratio of the group of plates 26 obtained in this experiment.

As can be seen from FIG. 13, as the simultaneously-driven nozzle number is increased, the droplet velocity gradually decreases. However, the droplet velocity becomes substantially constant from a certain number (for example, 16) onward, and from this point onward the droplet velocity is virtually constant even if the simultaneously-driven nozzle number is further increased.

Also, as shown in FIG. 14, as the simultaneously-driven nozzle number is increased, the deformation amount ratio gradually increases. However, the deformation amount ratio becomes virtually constant from a certain number onward, and from this point onward the deformation amount ratio is virtually constant even if the simultaneously-driven nozzle number is further increased.

Further, the simultaneously-driven nozzle number at which the droplet velocity ratio becomes constant and the simultaneously-driven nozzle number at which the deformation amount ratio becomes constant virtually coincide. It was found experimentally that virtually the same trend is shown if the nozzle pitch is 35 dpi or more and the total number of nozzles is around 45 or more. These experimental results also show that ink ejection velocity and amount of deformation of the plates 26 are closely related.

By forming comb-shaped projecting parts 12*f* in the high-rigidity housing 12 so that the each piezoelectric element 15 is located between adjacent projecting parts 12*f* and by fixing the projecting parts 12*f* to the diaphragm plate 10 as described above, the rigidity of the group of plates 26 can be increased in the opening 12*a* area. Thus, the amount of deformation of the group of plates 26 when the piezoelectric elements 15 are deformed for ejecting ink droplets can be suppressed. This makes it possible to convert expansion/contraction of the piezoelectric elements 15 efficiently to ink pressure changes and also to reduce the occurrence of crosstalk.

Figure 15:
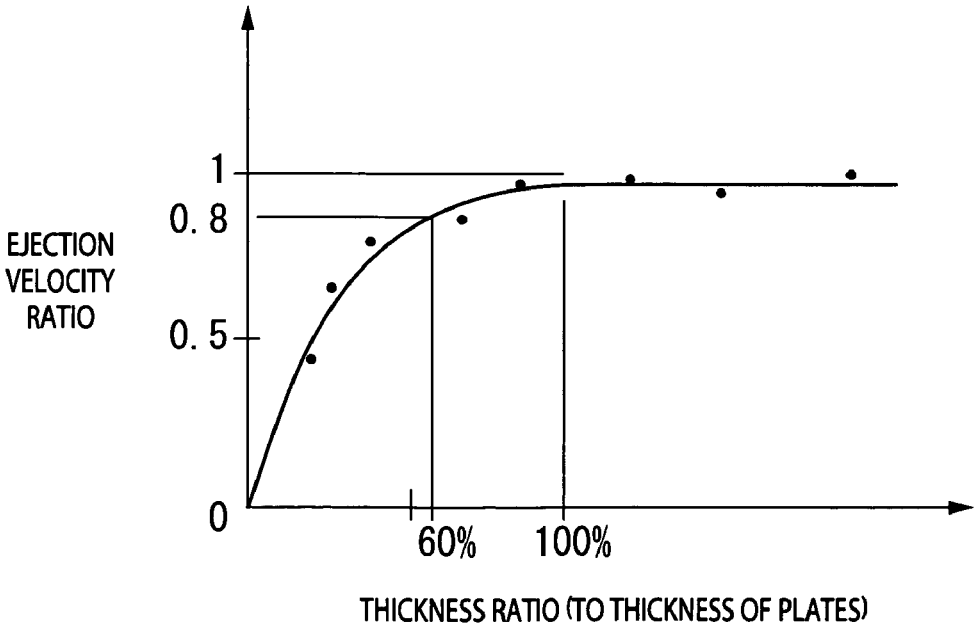
FIG. 15 is a graph showing the relationship between the droplet velocity ratio and a ratio of thickness of projecting parts to thickness of plates.

FIG. 15 shows the relationship between the above-described droplet velocity ratio and the ratio of thickness δ of the projecting parts 12*f* (FIG. 7) to the thickness of the entire group of plates 26 in the inkjet head of the present embodiment. As can be seen from the dotted line in FIG. 15, when the thickness δ of the projecting part 12*f* is 60% or more of the overall thickness of the group of plates 26, then change in the velocity ratio due to crosstalk is held down to 20% or less. Therefore, it is preferable that the thickness δ of the projecting part 12*f* be 60% or more of the overall thickness of the group of plates 26.

It is preferable that the thickness T of the protrusion 12*e* (FIGS. 4 and 7) be slightly less than the thickness D of the ink chamber plate 27 (FIG. 4). That is to say, although it is optimal that the thickness T of the protrusion 12*e* is the same as the thickness D of the ink chamber plate 27, it is extremely difficult to form the protrusion 12*e* and the ink chamber plate 27 to have the same thickness, and a bump or step is inevitably formed at the boundary between the projecting parts 12*f* and the ink chamber plate 27 due to variations in processing precision. By designing the thickness T of the protrusion 12*e* to be slightly smaller than the thickness D of the ink chamber plate 27, warp or deformation of the group of plates 26 is not affected by the flatness of the surface of the projecting parts 12*f*, but is affected only by the flatness of the plate attachment surface 27*a*. Therefore, even if the flatness of the surfaces of the projecting parts 12*f* is slightly insufficient, as long as the flatness of the plate attachment surface 27*a* is sufficient (for example, flatness of 10 μm), the effect on ejection characteristics due to warp or deformation of the group of plates 26 can made small. That is to say, although the nozzle plate 2, the channel plates 3, and the diaphragm plate 10 are thinner than the ink chamber plate 27 and easily warp or deform, by attaching the plate 10 to the ink chamber plate 27, which has greater strength than these plates 2, 3, and 10, the flatness of the ink chamber plate 27 directly affects the dimensional precision of the whole group of plates 26 and the channel shape of each nozzle. Thus, if the flatness of the plate attachment surface 27*a* is made highly precise, ink channels with little variation will be formed, and good ejection characteristics will be obtained.

By setting the thickness T of the protrusion 12*e* to be slightly smaller than the thickness D of the ink chamber plate 27 as described above, a recess is formed, when the housing 12 is attached to the ink chamber plate 27, on a surface confronting the diaphragm plate 10. By injecting sufficient adhesive material to this recess, the projecting parts 12*f* are affixed to the diaphragm plate 10.

As described above, according to the present embodiment, because the protrusion 12*e* formed with the opening grooves 12*d* in which piezoelectric elements 15 are inserted is formed integrally with the high-rigidity housing 12, it is possible to highly-precisely assemble the inkjet head 11 while suppressing positional misalignment, by fixing piezoelectric elements 15 to the diaphragms 8 with reference to the opening grooves 12*d*.

Furthermore, because the opening grooves 12*d* are formed in the protrusion 12*e* which is integrally formed with the housing 12, positional alignment between the opening grooves 12*d* and the group of plates 26 can be implemented with greater precision than when the protrusion 12*e* formed with the opening grooves 12*d* is attached to the housing 12 as a separate part and then affixed to the group of plates 26. Also, if the protrusion 12*e* having been processed with a high degree of precision and the housing 12 are formed as separate components, there is a danger that precision of these components deteriorates during handling or above-described affixing. However, there is no such problem in the case of when the protrusion 12*e* and the housing 12 are formed integrally with each other as in the present embodiment.

The configuration of the above-described inkjet head 11 is particularly effective when there are limitations on the mounting size. For example, even if the number of nozzles is 192 and the width of the inkjet head 11 is approximately 8 mm or less in order to achieve print resolution of 600 dpi, by forming the opening grooves 12*d* in the protrusion 12*e* of the high-rigidity housing 12, it is possible to form the projecting parts 12*f* each of which interposes between adjacent piezoelectric elements 15. Moreover, forming the protrusion 12*e* integrally with the housing 12 is effective in reducing cost.

While some exemplary embodiments of this invention have been described in detail, those skilled in the art will recognize that there are many possible modifications and variations which may be made in these exemplary embodiments while yet retaining many of the novel features and advantages of the invention.

For example, the high-rigidity housing 12 can be formed of stainless steel material for corrosion resistance with respect to various kinds of ink.

By forming positioning holes A and B in the high-rigidity housing 12, each of the plates 26, and the piezoelectric actuator 14 as shown in FIG. 4, positioning of the plates 26 is made much easier by assembling the various components with reference to those holes A and B.

Figure 16:
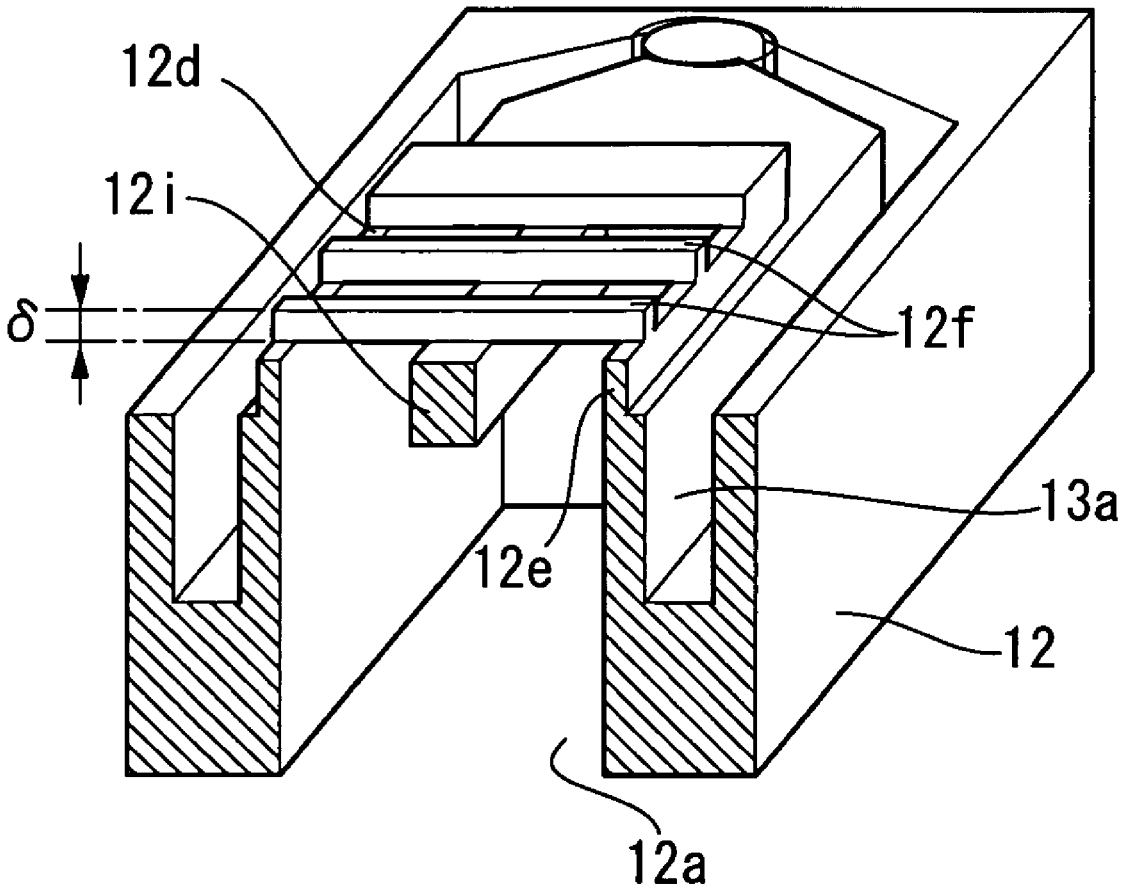
FIG. 16 is a partially cut-away perspective view showing a high-rigidity housing according to a modification of the embodiment of the present invention.

Also, as shown in FIG. 16, a linking bar 12*i* may be provided on the protrusion 12*e* of the high-rigidity housing 12. The linking bar 12*i* extends in a direction orthogonal to the lengthwise direction of the opening grooves 12*d* and links together the projecting parts 12*f*. It is preferable to provide the linking bar 12*i* in the center of the opening grooves 12*d* in the lengthwise direction of the opening grooves 12*d*. Also, if there are a plurality of rows of nozzles 1, it is preferable to position the linking bar 12*i* at a position between the rows. With this configuration, the rigidity of the projecting parts 12*f* and the plates 26 can be greatly increased, and deformation of the plates 26 during ink droplet ejection can be further reduced. Also, since the width of each projecting part 12*f* is extremely small (around 0.1 mm to 0.2 mm), there is a danger that the projecting parts 12*f* deform due to inclination of the dicing grindstone or the like during processing. However, the linking bar 12*i* prevents such deformation.

Moreover, the linking bar 12*i* further increases the rigidity of the diaphragm plate 10 and further reliably prevents the occurrence of crosstalk. Therefore, even if a plurality of piezoelectric elements 15 are driven simultaneously, ejection characteristics could be the same as that of when only one of the piezoelectric elements 15 is driven, providing a high-quality printing device.

What is claimed is:

1. An inkjet head comprising:

a nozzle plate formed with a plurality of nozzles through which ink droplets are ejected;

a channel plate formed with a plurality of pressure chambers corresponding to the respective nozzles;

a diaphragm plate that has a diaphragm, the diaphragm sealing the pressure chambers;

a plurality of piezoelectric elements attached to the diaphragm at positions opposite the respective pressure chambers; and a housing that houses the plurality of piezoelectric elements, wherein the housing has a central opening, and wherein:

the housing has a protrusion in contact with the diaphragm plate, the protrusion being formed with opening grooves and having projecting parts, each of the opening grooves being defined between adjacent two of the projecting parts, wherein the projecting parts bridge across the central opening; and each of the piezoelectric elements is inserted in the corresponding one of the opening grooves.

2. The inkjet head according to claim 1, wherein the projecting parts of the housing have greater rigidity than the diaphragm plate.

3. The inkjet head according to claim 1, further comprising an ink chamber plate located between the diaphragm plate and the housing, the ink chamber plate surrounding the protrusion of the housing.

4. The inkjet head according to claim 3, wherein: the ink chamber plate is formed with a common ink chamber through which ink is introduced into the pressure chambers; the housing is formed with an ink supply passage; the common ink chamber is fluidly connected to the ink supply passage at both lengthwise ends of the common ink chamber; and the ink chamber plate is fixed to the housing.

5. The inkjet head according to claim 3, wherein the projecting parts have a thickness less than a thickness of the ink chamber plate.

6. The inkjet head according to claim 3, wherein the projecting parts have a thickness that is at least 60% of total thickness of the nozzle plate, the channel plate, the diaphragm plate, and the ink chamber plate that are disposed one on the other.

7. The inkjet head according to claim 1, wherein the nozzles are arranged in two rows each extending in a predetermined direction, and the pressure chambers are arranged in two rows each extending in the predetermined direction and symmetrical about the rows of the nozzles.

8. The inkjet head according to claim 1, further comprising a securing member that supports the piezoelectric elements, wherein surfaces of ends of the piezoelectric elements at a first side occupy the same plane and affixed to the diaphragm plate, and ends of the piezoelectric elements at a second side opposite to the first side are fixed to the securing member.

9. The inkjet head according to claim 1, further comprising a linking member that mutually links the projecting parts.

10. The inkjet head according to claim 9, wherein the nozzles are formed in a plurality of rows each extending in a predetermined direction, and the linking member is located between two adjacent rows of the nozzles.

11. The inkjet head according to claim 9, wherein the opening grooves are arranged in a first direction, and each of the opening grooves has a length in a second direction perpendicular to the first direction, and the linking member is located at a center of the opening grooves with respect to the second direction.

12. The inkjet head according to claim 1, wherein the protrusion has a thickness that is greater than a depth of the opening grooves.

13. The inkjet head according to claim 1, wherein the projecting parts are parallel ribs extending across the central opening.

14. The inkjet head according to claim 1, wherein:

the nozzles are aligned in a row extending in a first direction; and the projecting parts are arranged in the first direction and bridge across the central opening in a second direction perpendicular to the first direction.

15. An ejection device comprising:

an inkjet head comprising:

a nozzle plate formed with a plurality of nozzles through which ink droplets are ejected;

a channel plate formed with a plurality of pressure chambers corresponding to the respective nozzles;

a diaphragm plate that has a diaphragm, the diaphragm sealing the pressure chambers;

a plurality of piezoelectric elements attached to the diaphragm at positions opposite the respective pressure chambers; and a housing that houses the plurality of piezoelectric elements, wherein the housing has a central opening, and wherein:

the housing has a protrusion in contact with the diaphragm plate, the protrusion being formed with opening grooves and having projecting parts, each of the opening grooves being defined between adjacent two of the projecting parts, wherein the projecting parts bridge across the central opening; and each of the piezoelectric elements is inserted in the corresponding one of the opening grooves; and an ink cartridge that supplies ink to the inkjet head.

16. The ejection device according to claim 15, wherein the inkjet head further includes an ink chamber plate located between the diaphragm plate and the housing, the ink chamber plate surrounding the protrusion of the housing.

17. The ejection device according to claim 16, wherein the projecting parts have a thickness less than a thickness of the ink chamber plate.

18. The ejection device according to claim 16, wherein the projecting parts have a thickness that is at least 60% of total thickness of the nozzle plate, the channel plate, the diaphragm plate, and the ink chamber plate that are laminated one on the other.

19. The ejection device according to claim 16, wherein the channel plate includes a chamber plate formed with the pressure chambers and a restrictor plate formed with a plurality of restrictors.

20. The ejection device according to claim 15 wherein the inkjet head further includes a linking member that mutually links the projecting parts.

21. The ejection device according to claim 15, wherein the protrusion has a thickness that is greater than a depth of the opening grooves.

22. The ejection device according to claim 15, wherein:

the nozzles are aligned in a row extending in a first direction; and the projecting parts are arranged in the first direction and bridge across the central opening in a second direction perpendicular to the first direction.

* * * * *